US009679721B2

(12) United States Patent
Rhein et al.

(10) Patent No.: US 9,679,721 B2
(45) Date of Patent: Jun. 13, 2017

(54) AIR BREAK ELECTRICAL SWITCH HAVING A BLADE TOGGLE MECHANISM

(71) Applicant: Power Products, LLC, Menomonee Falls, WI (US)

(72) Inventors: David A. Rhein, St. Jacob, IL (US); Andrew Kellerman, Belleville, IL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/424,843

(22) PCT Filed: Aug. 30, 2013

(86) PCT No.: PCT/US2013/057673

§ 371 (c)(1),
(2) Date: Feb. 27, 2015

(87) PCT Pub. No.: WO2014/074211

PCT Pub. Date: May 15, 2014

(65) Prior Publication Data

US 2015/0243459 A1 Aug. 27, 2015

Related U.S. Application Data

(60) Provisional application No. 61/695,816, filed on Aug. 31, 2012.

(51) Int. Cl.

| | |
|---|---|
| ***H01H 33/42*** | (2006.01) |
| ***H01H 33/12*** | (2006.01) |
| ***H01H 33/04*** | (2006.01) |

(52) U.S. Cl.

CPC ..... *H01H 33/42* (2013.01); *H01H 33/04* (2013.01); *H01H 33/127* (2013.01)

(58) Field of Classification Search

CPC ..... H01H 33/04; H01H 33/42; H01H 33/127; H01H 31/28; H01H 31/30; H01H 31/00

(Continued)

(56) References Cited

U.S. PATENT DOCUMENTS

| | | | |
|---|---|---|---|
| 2,889,435 | A | 6/1959 | Albright |
| 3,244,827 | A | 4/1966 | Kussmaul |

(Continued)

FOREIGN PATENT DOCUMENTS

| | | |
|---|---|---|
| WO | 2012099919 | 7/2012 |
| WO | 2012099919 A1 | 7/2012 |

OTHER PUBLICATIONS

International Preliminary Report on Patentability for PCT Application No. PCT/US2013/057673 dated May 13, 2014 (5 pages).

(Continued)

*Primary Examiner* — Renee Luebke
*Assistant Examiner* — William Bolton
(74) *Attorney, Agent, or Firm* — Michael Best & Friedrich, LLP

(57) ABSTRACT

A high voltage/high current air break switch, the switch including a support frame and a blade pivotally supported by the support frame, so as to be pivotable relative to the support frame. The blade includes a load interrupter between a blade support and the distal end of the blade. And a method of operating an air break electrical switch with a swinging blade mounted on a support and having blade contacts brought into and out of engagement with a terminal with terminal contacts, and a load interrupter with contacts in a vacuum bottle, the method steps comprising turning the support to move the blade relative to the terminal, then turning the support to move the vacuum bottle electrical contacts and to move the blade contacts relative to the terminal contacts.

5 Claims, 20 Drawing Sheets

(58) Field of Classification Search
USPC ..... 218/146, 69, 100, 107; 200/48 KB, 200/48 SB
See application file for complete search history.

(56) References Cited

U.S. PATENT DOCUMENTS

| | | | | | |
|---|---|---|---|---|---|
| 3,382,330 | A | * | 5/1968 | Bernatt | H01H 3/42 200/48 A |
| 3,566,061 | A | * | 2/1971 | Bernatt | H01H 33/16 200/48 R |
| 3,627,939 | A | * | 12/1971 | Myers | H01H 1/38 200/48 SB |
| 3,824,359 | A | * | 7/1974 | Date | H01H 33/6661 218/10 |
| 4,112,268 | A | * | 9/1978 | Chung | H01H 31/20 200/48 SB |
| 4,435,626 | A | | 3/1984 | Coffin | |
| 4,591,678 | A | * | 5/1986 | Yin | H01H 33/128 218/121 |
| 5,652,419 | A | | 7/1997 | Amonett et al. | |
| 5,739,490 | A | | 4/1998 | Amonett et al. | |
| 2002/0179571 | A1 | | 12/2002 | Rhein et al. | |

OTHER PUBLICATIONS

PCT/US2013/057673 International Search Report dated May 13, 2014 (1 page).

* cited by examiner

AIR BREAK ELECTRICAL SWITCH HAVING A BLADE TOGGLE MECHANISM

CROSS-REFERENCE TO RELATED APPLICATION

This application claims the benefit of U.S. Provisional Patent Application No. 61/695,816 filed Aug. 31, 2012, the disclosure of which is hereby incorporated by reference in its entirety.

STATEMENT CONCERNING FEDERALLY SPONSORED RESEARCH OR DEVELOPMENT

Not applicable.

FIELD OF THE DISCLOSURE

This disclosure relates to a high voltage/high current air break switch that rotates about multiple axes to engage a distal electrical terminal, and a load interrupter for interrupting current passing through the switch.

BACKGROUND OF THE DISCLOSURE

High voltage/high current air break switches typically include an elongated conductive contact or "blade" that is locked or otherwise secured to a distal electrical terminal during operation to ensure that the components remain in contact. Relatively large forces must be established and overcome to move the blade into a locking position to assure a stable conductive connection.

In a conventional air break electric switch, as described below, a load interrupter is located in series with the switch. The load interrupter helps to prevent electrical arcing at the terminal contacts, is usually located adjacent the switch, and must be operated prior to the bringing into or out of, of contact between the blade and its distal electric terminal. This adds to the space needs of the frame that supports the switch, and increases the complexity of the switch and load interrupter operation.

There is therefore a need to simplify the overall construction of the switch and load interrupter assembly, as well as a need to reduce the space needed by the assembly. There is also a need to reduce the complexity of the operation of the assembly.

Therefore, a need exists for an improved air break switch that addresses one or more of the above drawbacks of previous switch designs.

SUMMARY OF THE DISCLOSURE

This disclosure provides a high voltage/high current air break switch, the switch including a support frame and a blade pivotally supported by the support frame, so as to be pivotable relative to the support frame. The blade includes a load interrupter between a blade support and the distal end of the blade. This disclosure also provides a method of operating an air break electrical switch with a swinging blade mounted on a support and having blade contacts brought into and out of engagement with a terminal with terminal contacts, and a load interrupter with contacts in a vacuum bottle, the method steps comprising turning the support to move the blade relative to the terminal, then turning the support to move the vacuum bottle electrical contacts and to move the blade contacts relative to the terminal contacts.

The foregoing and other objects and advantages of the disclosure will appear in the detailed description which follows. In the description, reference is made to the accompanying drawings which illustrate a preferred embodiment of the disclosure.

BRIEF DESCRIPTION OF THE DRAWINGS

An air break electrical switch will hereafter be described with reference to the accompanying drawings, wherein like reference numerals denote like elements.

DESCRIPTION OF A CONVENTIONAL AIR BREAK ELECTRICAL SWITCH

Figure 1:
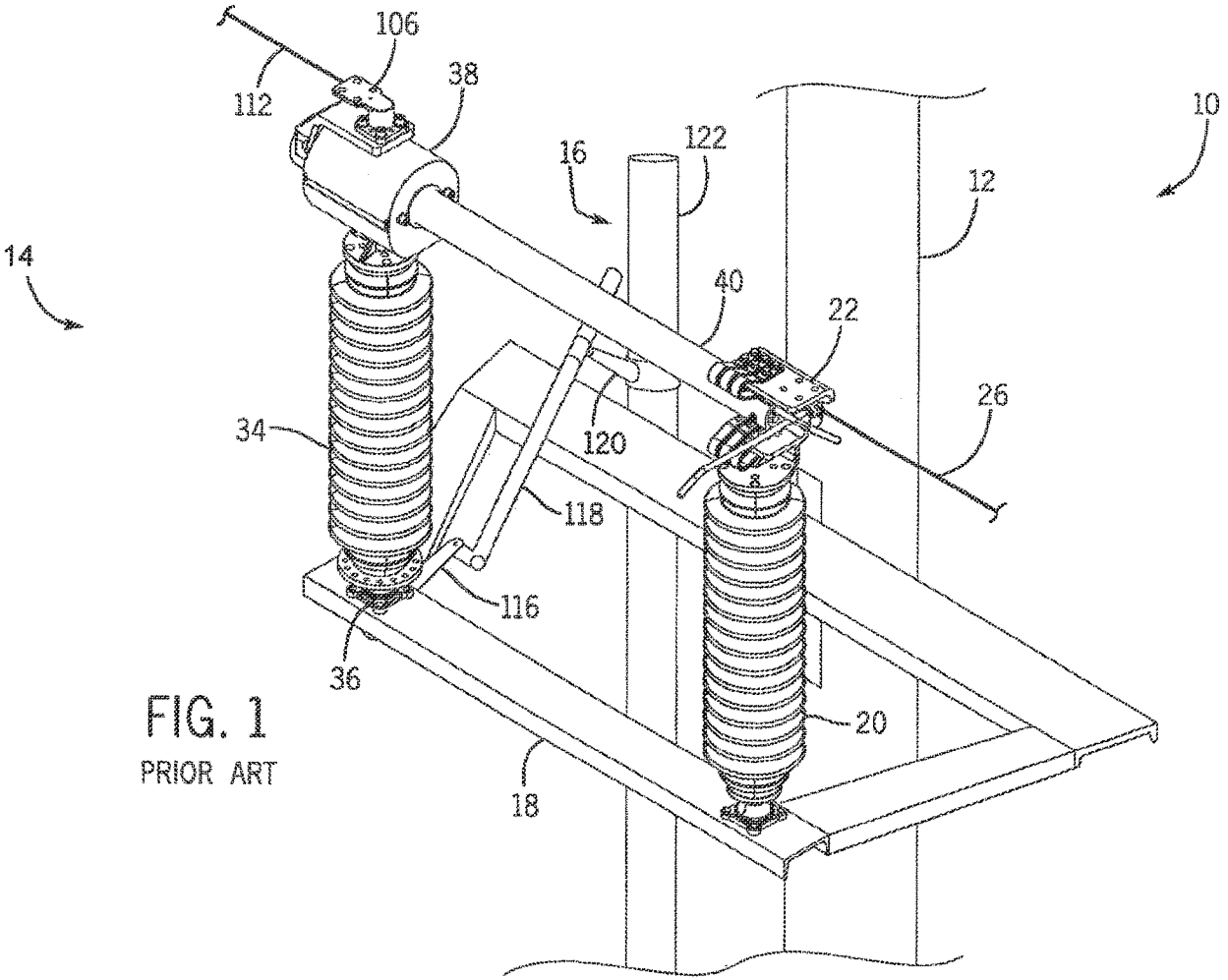
FIG. 1 PRIOR ART
FIG. 1 is a perspective view of a utility structure supporting an air break switch in a closed blade position and a closed contact position in which terminals of the switch are electrically connected.

Referring first to FIG. 1, a high voltage/high current electrical or air break switch 10 may be supported by many types of appropriate utility structures, such as a utility pole 12. In general, the switch 10 includes one or more upper switches 14 disposed above the ground and an operating mechanism 16 extending from the upper switch 14 toward the ground. The operating mechanism 16 may be driven by an electrical technician on the ground to move the upper switch 14 between different operating positions. The present switch 10 includes features that effectively inhibit a conductive blade 40 from prematurely pivoting to a position in which it is configured to contact a distal terminal. These aspects are described in further detail in the following paragraphs.

Referring to FIGS. 1-4, the general structure of the upper switch 14 will first be described. The upper switch 14 includes a support frame 18 fixedly connected to the utility pole 12. The support frame 18 mounts both stationary and pivotable switch components. Regarding the stationary switch components, a first end of the support frame 18 mounts a first elongated insulator 20. The first insulator 20 supports a first electrical terminal 22 above the frame 18 and, as such, the first electrical terminal 22 is electrically isolated from the frame 8.

Referring now to FIGS. 2-6, the first electrical terminal 22 includes a conductor contact 24 for connection to another electrical conductor, such as a transmission wire 26 (FIG. 1). The electrical terminal 22 also includes one or more terminal contacts 28. The terminal contacts 28 are preferably arranged in upper and lower pairs and each contact 28 in a pair is spring-biased toward the other contact 28 in the pair. The function of the terminal contacts 28 is described in further detail below. A lock bracket 30 (FIGS. 4 and 5) is disposed between the pairs of the terminal contacts 28. The function of the lock bracket 30 is also described in further detail below.

The first electrical terminal 22 may also include a first arcing arm 32 (FIGS. 4-6) to prevent electrical arcing at the terminal contacts 28. Furthermore, the first electrical terminal 22 may also support a load interrupter (not shown), such as the load interrupter described in U.S. Pat. No. 4,492,835, the disclosure of which is hereby incorporated by reference in its entirety, or one commercially available from Turner Electric Company, Edwardsville, Ill. The first electrical terminal 22 may also support a corona shield (not shown).

Returning to FIGS. 1-4 and regarding the pivotable switch components, the support frame 18 also mounts a second elongated insulator 34 opposite the first insulator 20. The second insulator 34 is pivotably connected to the support frame 8, e.g., via a bearing assembly 36. Furthermore, the second insulator 34 also connects to the operating mechanism 16 and is pivoted thereby as described in further detail below. The second insulator 34 mounts a blade support 38 and the electrically conductive tubular blade 40 that is pivotable to selectively provide an electrical connection with the first electrical terminal 22. In less preferred embodiments, the blade support can be pivotally mounted (not shown) to the top of the second insulator.

Rotating the operating mechanism 16 pivots the second insulator 34 about a vertical axis. As such, the operating mechanism 16 pivots the blade 40 from a closed blade position (FIG. 1) to an open blade position (FIG. 3) and vice versa. Specifically, pivoting the operating mechanism 16 in a first direction (i.e., clockwise as viewed from above) drives the blade 40 toward the closed blade position, and pivoting the operating mechanism 16 in a second direction (i.e., counter-clockwise as viewed from above) drives the blade 40 toward the open blade position.

Figure 5:
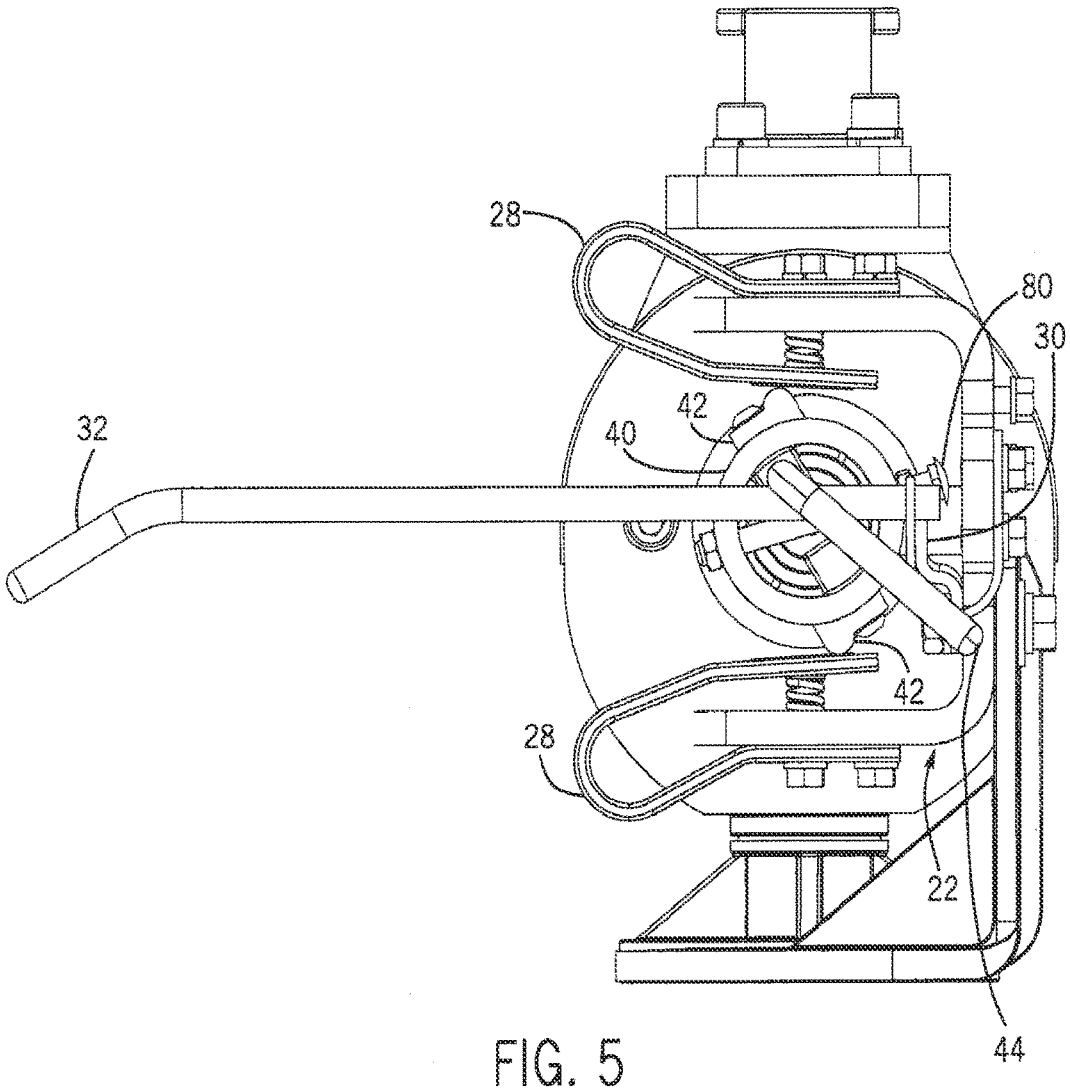
FIG. 5 PRIOR ART
FIG. 5 is a side view of the air break switch moving toward the open contact position.
Figure 6:
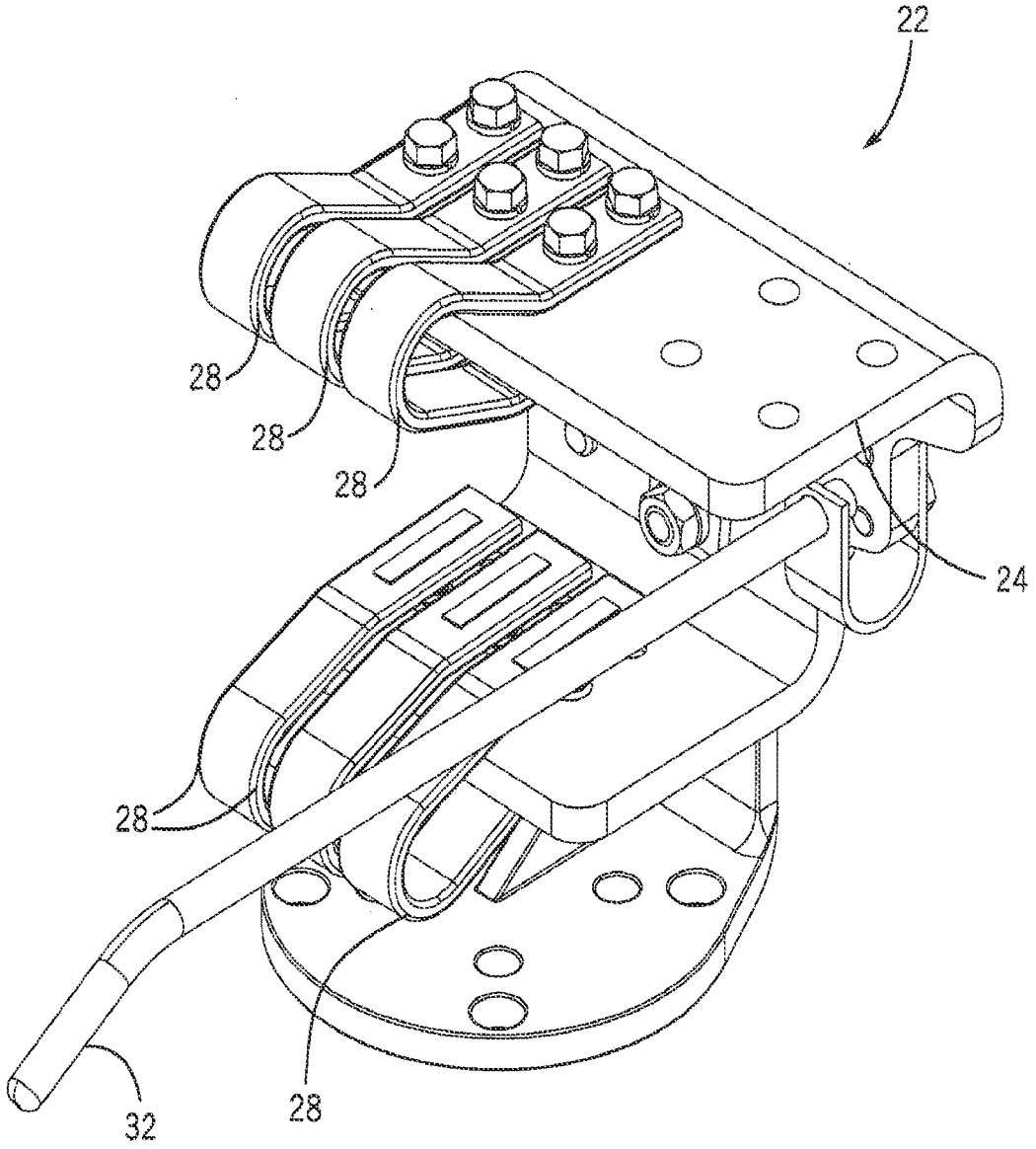
FIG. 6 PRIOR ART
FIG. 6 is a perspective view of one of the electrical terminals of the air break switch.
Figure 7:
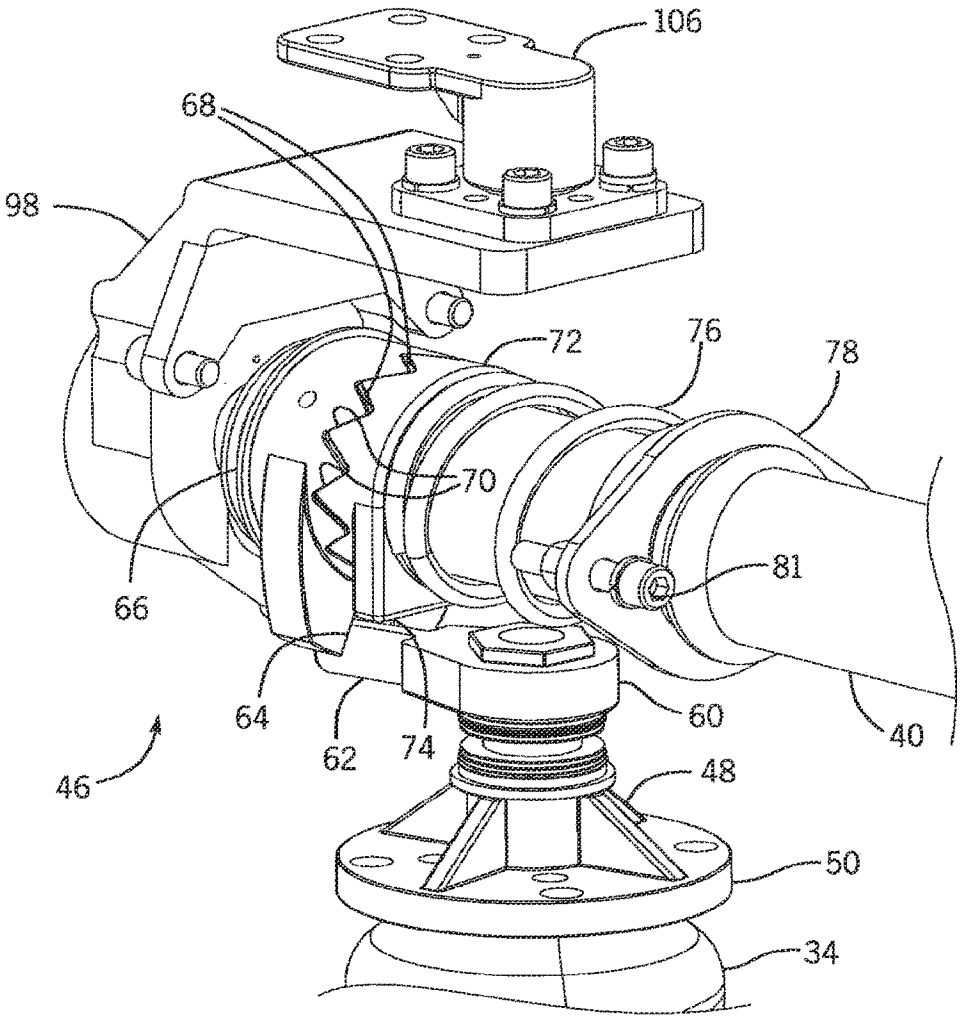
FIG. 7 PRIOR ART
FIG. 7 is a perspective view of a toggle mechanism of the switch in the closed contact position of FIG. 1 with a blade support housing removed for clarity.

Referring now to FIGS. 1, 4, 5 and 7-10, the blade support 38 mounts the blade 40 such that the blade 40 is pivotable about its longitudinal axis from a closed contact position (FIG. 4) to an open contact position (the blade 40 is shown moving toward the open contact position in FIG. 5) and vice versa. As the name implies, in the closed contact position, contacts 42 on the end of the blade 40 proximate the first electrical terminal 22 engage the terminal contacts 28 to electrically connect the first terminal 22 and the blade 40. Conversely, in the open contact position, the blade contacts 42 disengage the terminal contacts 28, although the first electrical terminal 22 and the blade 40 may still be electrically connected by contact between the first arcing arm 32 and a second arcing arm 44 supported by the blade 40.

The blade contacts 42 engage the first electrical terminal 22 in order to have current flow from the second terminal to the first terminal, and vice versa. After driving the blade 40 to the closed blade position, the blade contacts 42 are not yet in contact with the first electrical terminal 22. Rotation of the blade 40 causes the blade contacts 42 to engage the first electrical terminal 22, as further explained below.

After the blade 40 reaches the first electrical terminal 22, the blade 40 and blade support 38 can no longer rotate about the second terminal's vertical axis. Thus, further rotation of the second terminal 34 about its vertical axis results no longer in the swinging of the blade 40, but instead results in the pivoting of the blade and movement of the blade contacts 42 from a contact open position to a contact closed position, as further described below.

Figure 9:
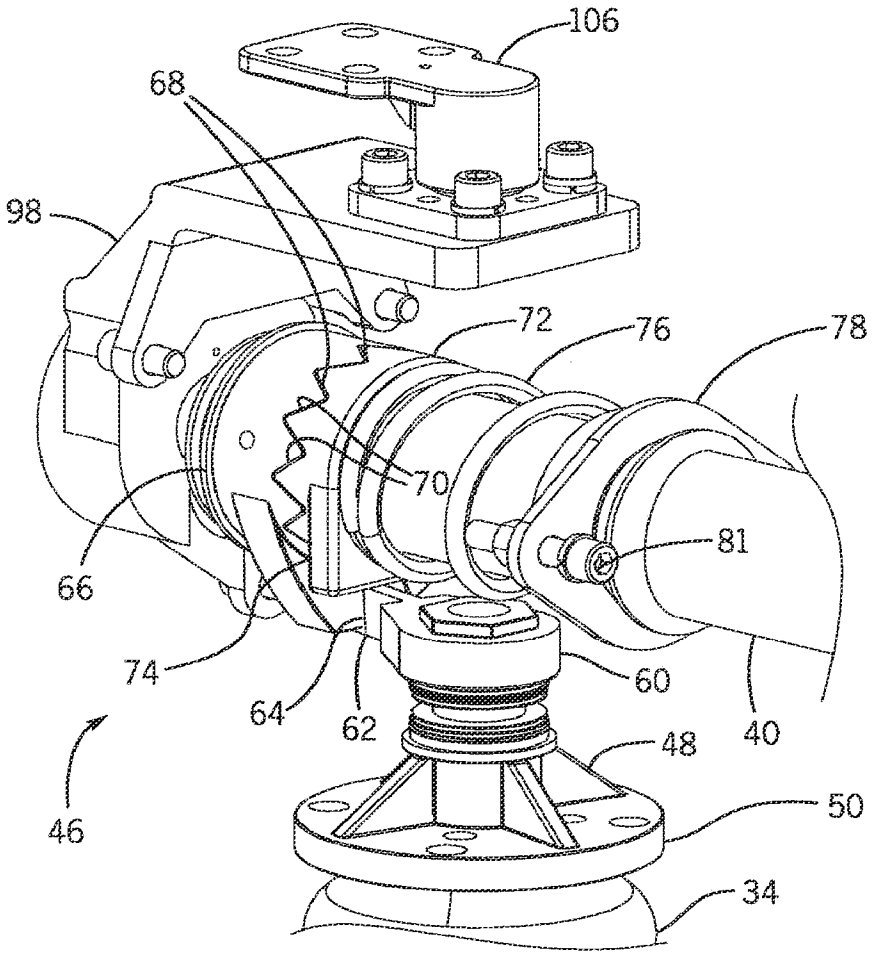
FIG. 9 PRIOR ART
FIG. 9 is a perspective view of the toggle mechanism in the open contact position with the blade support housing removed for clarity.
Figure 10:
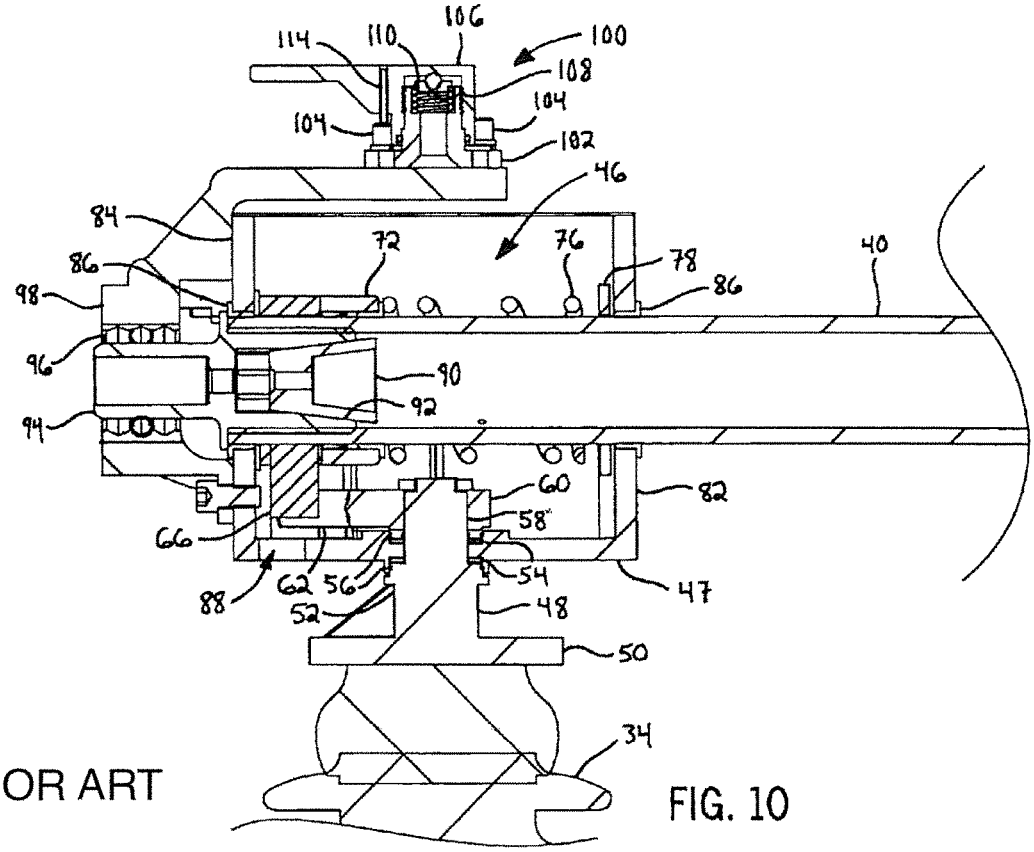
PRIOR ART FIG. 10
FIG. 10 is a sectional view of the toggle mechanism and the blade in the open contact position.

To facilitate the pivotal motion of the blade 40 described in the previous paragraph, the blade support 38 includes a toggle mechanism 46 (FIGS. 7-10) that connects to a blade support housing 47 (FIG. 10). The toggle mechanism 46 includes a rotator 48 fixedly connected to the second insulator 34, e.g., via fasteners (not shown) extending through a rotator mounting flange 50. As such, the rotator 48 pivots with the second insulator 34 when it is driven by the operating mechanism 16. The rotator 48 also includes a rotator coupling section 52 (FIG. 10) above the mounting flange 50. The rotator coupling section 52 supports two bearings 54 and seals 56, and as such, the rotator coupling section 52 rotatably supports the blade support housing 47. In addition, the rotator 48 includes a keyed coupling section 58 (FIG. 10) above the rotator coupling section 52. The keyed coupling section 58 engages a cam or toggle lever 60 via one or more keys (not shown), and as such, the toggle lever 60 pivots with the rotator 48 and the second insulator 34 when they are driven by the operating mechanism 16.

The toggle lever 60 includes a pin 62 that extends away from the first electrical terminal 22. The pin 62 engages a slot 64 (FIG. 7) of a first toggle or over—center member 66 that fixedly surrounds the blade 40 and connects thereto, e.g., via fasteners (not shown). The first toggle member 66 has a crown shape with a first set of crown points 68 disposed at one end. The first set of crown points 68 engages and interdigitates with a second set of crown points 70 of a second toggle or over-center member 72. The second toggle member 72 is translatably and pivotally supported by the blade 40; however, the second toggle member 72 includes a flange 74 that contacts an interior wall of the blade support housing 47 to inhibit the second toggle member 72 from rotating relative to the housing 47. The second toggle member 72 is also biased into engagement with the first toggle member 66 by a compression spring 76 disposed between the second toggle member 72 and a housing bracket 78. The interactions between the first toggle member 66, the second toggle member 72, and the spring 76, and their effect on motion of the blade 40, are described in further detail in the following paragraph.

Figure 2:
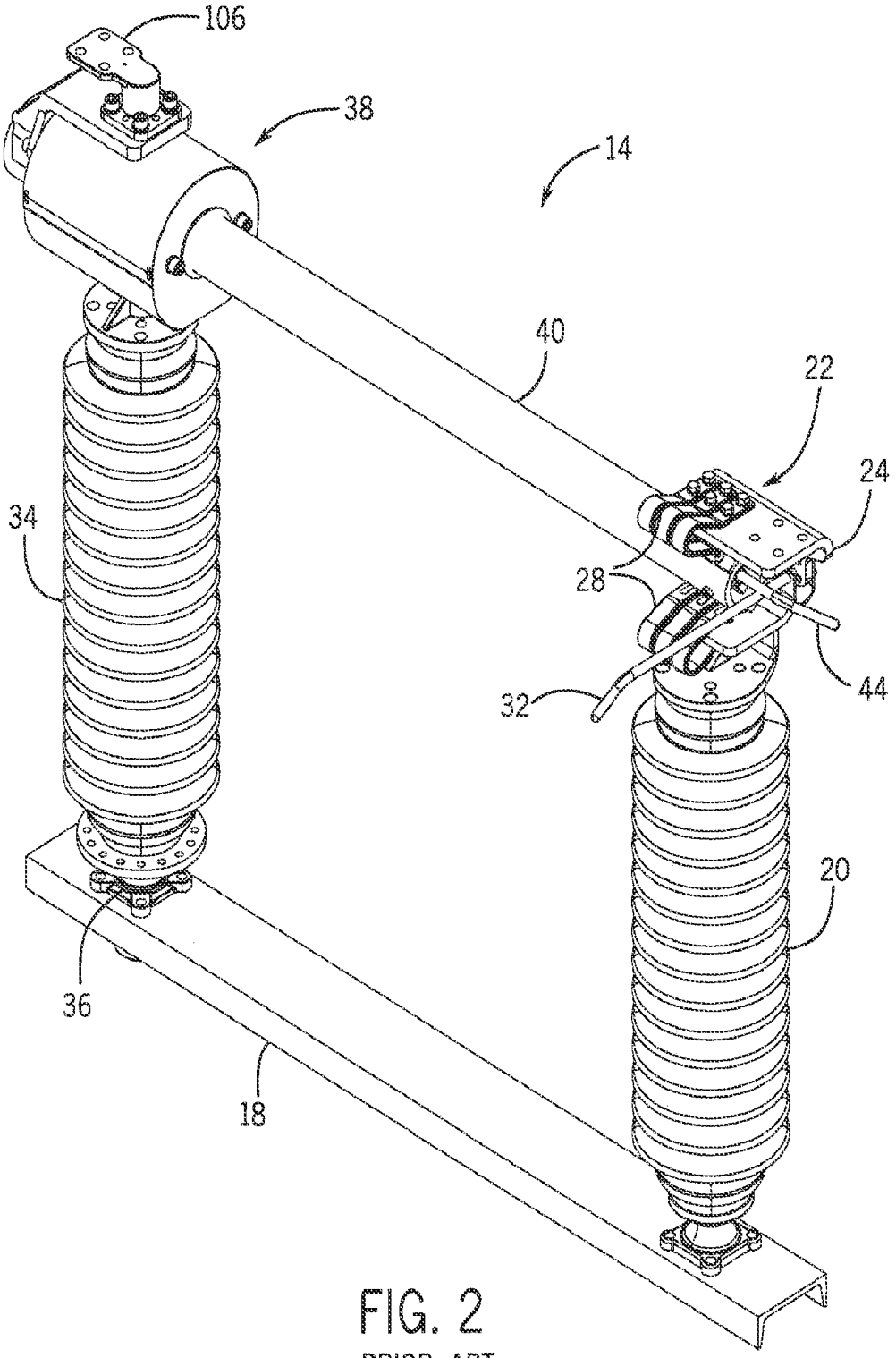
FIG. 2 PRIOR ART
FIG. 2 is a perspective view of the air break switch of FIG. 1 with the blade pivoting to an open contact position in which the terminals are no longer electrically connected.
Figure 3:
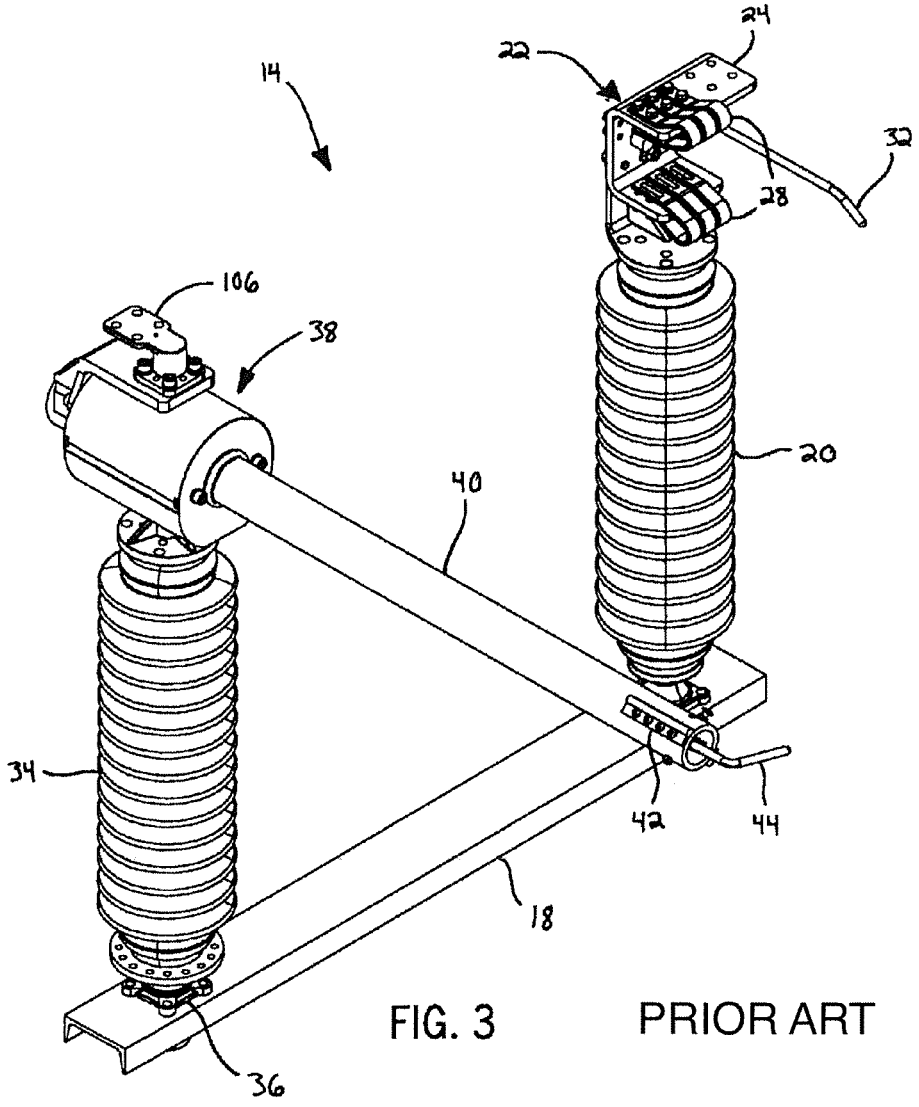
FIG. 3 PRIOR ART
FIG. 3 is a perspective view of the air break switch of FIG. 1, with the blade pivoted to an open blade position in which the terminals are electrically isolated.
Figure 4:
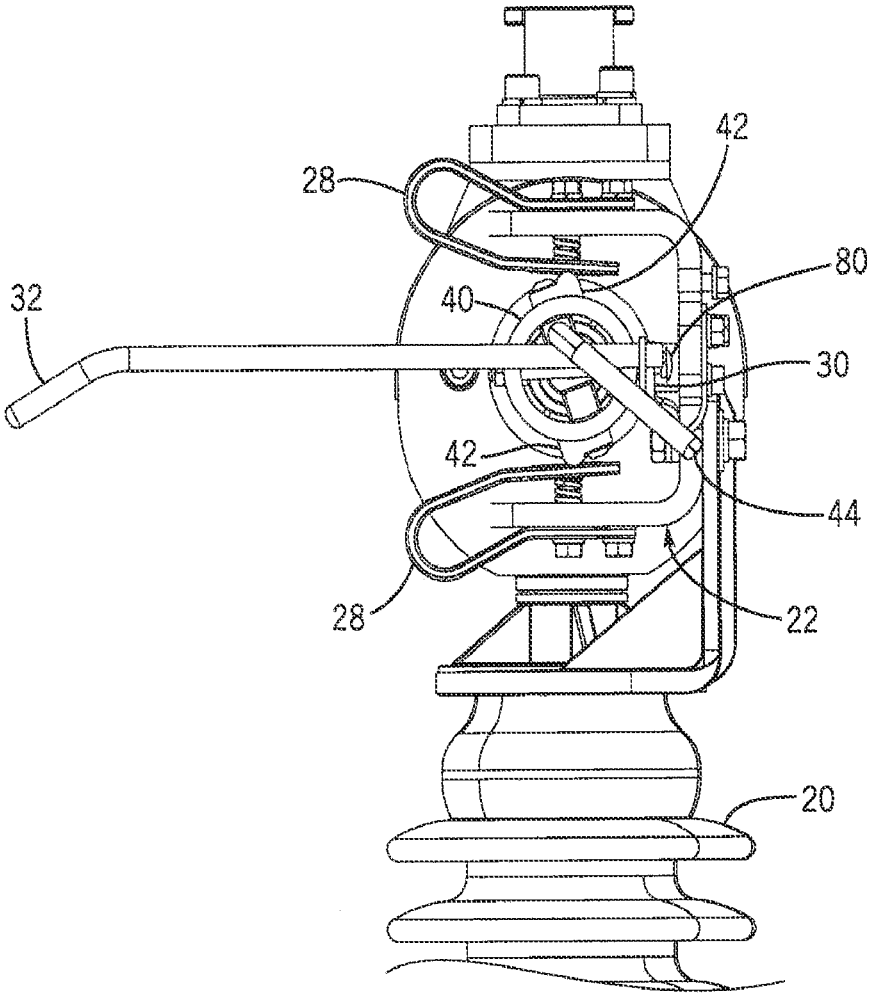
FIG. 4 PRIOR ART
FIG. 4 is a side view of the air break switch in the closed blade position and closed contact position of FIG. 1.
Figure 8:
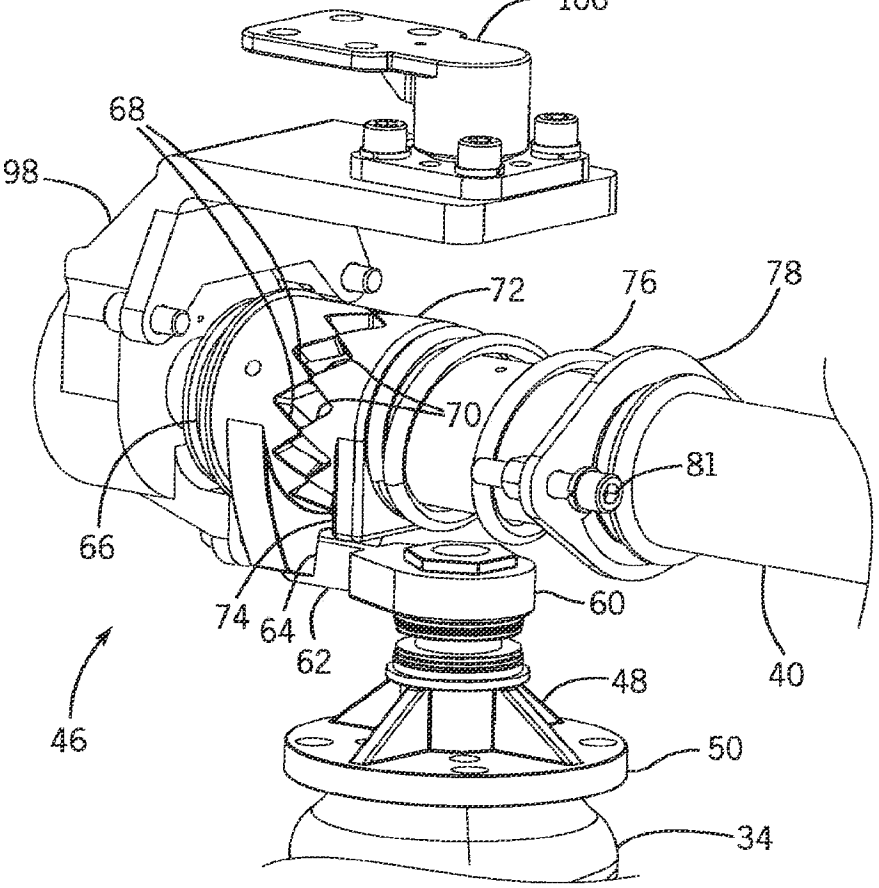
FIG. 8 PRIOR ART
FIG. 8 is a perspective view of the toggle mechanism moving toward the open contact position with the blade support housing removed for clarity.

If the blade 40 is in the open blade position and the open contact position (i.e., the configuration shown in FIG. 3), clockwise motion of the operating mechanism 16 tends to pivot the toggle lever 60 (FIG. 9) in a counter-clockwise direction. This occurs after the blade 40 and the blade support housing 47 can no longer rotate because of the contact between the blade 40 and the first terminal 22. This motion of the toggle lever 60 tends to pivot the first toggle member 66 and the blade 40 about both the vertical axis (about which the toggle lever 60 pivots) and the longitudinal axis of the blade 40. However, the torque needed to pivot the first toggle member 66 and the blade 40 about its longitudinal axis is relatively high due to the pivotally fixed relationship of the second toggle member 72 to the blade support housing 47, engagement of the first and second sets of crown points 68 and 70, and the spring 76. The torque needed to pivot the first toggle member 66 and the blade 40 about the vertical axis is relatively low and, as such, the blade 40 first pivots to the closed blade position (FIG. 2). Upon reaching the closed blade position, the torque needed to pivot the blade 40 about the vertical axis increases significantly due to contact between the blade 40 and the first electrical terminal 22. As such, continued clockwise motion of the operating mechanism 16 causes the first toggle member 66 and the blade 40 to pivot about the longitudinal axis as the first set of crown points 68 slip over the second set of crown points 70 (FIG. 8). After the crown points 68, 70 pass "over center" (i.e., past a position in which the tips contact each other), the spring 76 forces the second toggle member 72 toward the first toggle member 66. This action causes the first and second crown points 68, 70 to interdigitate in a configuration (FIG. 7) different than the previous configuration. In addition, the blade contacts 42 engage the terminal contacts 28 (i.e., the blade 40 enters the closed contact position).

A simple latching mechanism inhibits the blade 40 from returning directly to the open blade position (FIG. 3) after entering the closed contact position. In particular, and as shown most clearly in FIGS. 4 and 5, the latching mechanism includes a bolt 80 supported at the same end of the blade 40 as the blade contacts 42. The shank of the bolt 80 is sized to enter a slot of the lock bracket 30 of the first terminal 22 as the blade 40 pivots to the closed contact position. However, the head of the bolt 80 is oversized relative to the slot. As such, the bolt 80 engages the bracket 30 and thereby inhibits the blade 40 from pivoting about the vertical axis (i.e., toward the open blade position) before it pivots about its longitudinal axis.

To return the blade 40 to the open contact position and the open blade position, the operating mechanism 16 is pivoted in a counter-clockwise direction to pivot the toggle lever 60 (FIG. 7) in a clockwise direction. This motion of the toggle lever 60 tends to pivot the first toggle member 66 and the blade 40 about both the vertical axis and the longitudinal axis of the blade 40. However, the blade 40 does not immediately pivot about the vertical axis due to engagement of the bolt 80 and the lock bracket 30 as described above. As such, the first toggle member 66 and the blade 40 first pivot about the longitudinal axis as the first set of crown points 68 slip over the second set of crown points 70 (FIG. 8). After the crown points 68, 70 pass over center, the spring 76 forces the second toggle member 72 toward the first toggle member 66. This action causes the first and second crown points 68, 70 to interdigitate in their original configuration (FIG. 9). In addition, the blade contacts 42 disengage the terminal contacts 28 (i.e., the blade 40 enters the open contact position) and the bolt 80 disengages the lock bracket 30. As such, continued counter-clockwise motion of the operating mechanism 16 pivots the blade 40 about the vertical axis (i.e., toward the open blade position).

In order to ensure the toggle mechanism 46 does not force the blade 40 to return to the closed contact position when the operating mechanism 16 is pivoted in a counter-clockwise direction, the spring-biased terminal contacts 28 preferably remain in engagement with the blade contacts 42 until the toggle mechanism 46 passes over center. That is, friction between the terminal contacts 28 and the blade contacts 42 holds the blade 40 in the closed blade position until the blade 40 pivots from the closed contact position and the toggle mechanism 46 passes over center. Conversely, if the terminal contacts 28 were to disengage the blade contacts 42 before the toggle mechanism 46 passed over center, the blade 40 would begin to pivot vertically due to motion of the operating mechanism 16, but the second toggle member 72 and the compression spring 76 would force the blade 40 to pivot back to the closed contact position.

The spring constant of the compression spring 76 may be selected to provide an appropriate torque threshold to be exceeded to pivot the blade 40 about its axis. An appropriate torque threshold is higher than the torque needed to pivot the blade 40 about the vertical axis but preferably not so high that an operator cannot easily apply the torque to the operating mechanism 16. Additionally, the housing bracket 78 may be adjustable (e.g., by turning fasteners 81) to vary the force applied by the second toggle member 72 to the first toggle member 66.

Referring now specifically to FIG. 10, the remainder of the blade support 38 will be described. The blade support housing 47 includes front and rear walls 82 and 84 that pivotally support the blade 40 via bushings 86. The blade support housing 47 also includes a drain hole 88 that prevents moisture from accumulating within the blade support housing 47.

The blade 40 is attached internally to a blade end cap 90. A proximal portion 92 of the blade end cap 90 is outwardly expandable to ensure that the blade end cap 90 and the blade 40 remain in contact and electrically connected. A distal portion 94 of the blade end cap 90 is surrounded and contacted by one or more current transfer springs 96. The current transfer springs 96 are disposed within a terminal support 98.

The terminal support 98 mounts a second electrical terminal 100 above the blade support housing 47. The second electrical terminal 100 includes a terminal mounting 102 that fixedly connects to the terminal support 98 via fasteners 104. The terminal mounting 102 pivotally supports a conductor contact 106 via a threaded connection 108. A compression spring 110 disposed within the terminal mounting 102 biases the conductor contact 106 to ensure the terminal mounting 102 and the conductor contact 106 remain in contact and electrically connected through the threaded connection 108. The conductor contact 106 is pivotable relative to the terminal mounting 102 via the threaded connection 108 to reduce stress on another electrical conductor, such as a transmission wire 112 (FIG. 1), connected to the conductor contact 106. However, the range of motion of the conductor contact 106 is limited by a pin 14 that contacts the fasteners 104.

Referring again to FIG. 1, the operating mechanism 16 will now be briefly described in further detail. The operating mechanism 16 includes a bracket 116 fixedly connected to the second insulator 34. The bracket 16 pivotally connects to and is driven by an elongated link 118. The elongated link 118 pivotally connects to and is driven by a short link 120. The short link 120 fixedly connects an elongated vertical shaft 122 that extends from the upper switch 14 toward the ground. [0044] The switch 10 may comprise appropriate materials recognized by those skilled in the art. For example, the blade 40 may comprise aluminum and the terminals 22 and 100 and the blade support 38 may comprise copper, silver-coated metals, or the like. The insulators 20 and 34 may comprise ceramics.

It should be apparent that the electrical conductors (e.g., transmission wires 26 and 112) connected to the first and second electrical terminals are selectively electrically connectable by engaging and disengaging the blade from the first electrical terminal. Furthermore, the toggle mechanism inhibits the blade from pivoting about its own axis before pivoting proximate the first electrical terminal.

DESCRIPTION OF A PREFERRED EMBODIMENT OF THE DISCLOSURE

FIGS. 11 to 20 illustrate an improved air break electrical switch 200 according to this disclosure. Where like components to the previously described switch are shown, like reference numbers have been used. Like numbers with an accent added are similar in function, but modified. And unless specifically described or illustrated as different, all components and operations of the conventional switch 10 and the improved switch 200 are the same.

Briefly, this improved air break electrical switch 200 incorporates a load interrupter into the blade portion of the switch, thus eliminating the need for a load interrupter separate from the air break electrical switch. This improved air break electrical switch 200 also incorporates means for operating the load interrupter, with operation of the air break electrical switch 200.

More particularly, the high voltage/high current air break switch 200 includes a support frame 18 and stationary and pivotable switch components mounted on the support frame, the components including a first elongated insulator 20, such as a ceramic insulator, and a second elongated insulator 34 pivotally connected to the support frame 18, such as a ceramic insulator, spaced apart from the first elongated insulator 20. The switch 200 also includes a distal electrical terminal 22 mounted on the first elongated insulator 20 and including a conductor contact 24 for connection to another electrical conductor, such as a transmission wire. The switch 200 also includes a blade support housing 47 mounted on the second elongated insulator 34, and a blade 40' supported by the blade support housing 47 and having a distal end. The blade 40' includes a load interrupter 216 in the blade 40' between the blade support housing 47 and the distal end of the blade 40', the load interrupter 216 comprising a vacuum bottle 256 surrounded by a layer of urethane and enclosed in a cycloaliphatic housing 215. Mounted within the vacuum bottle 256 is a fixed contact 232 electrically connected to blade contacts 42, and a vacuum bottle movable contact 234 movable relative to the vacuum bottle 256 between a position in contact with the fixed vacuum bottle contact 232, and a position spaced apart from the vacuum bottle fixed contact 232. Pivotal movement of the second elongated insulator 34 pivots the blade 40' from an open blade position, in which the blade distal end is spaced apart from the electrical terminal 22, to a closed blade position, in which the blade distal end enters the electrical terminal 22. Pivotal movement of the blade 40' also opens and closes the load interrupter 216 so that the load interrupter operates first when opening and operates last when closing of the switch. Pivotal movement of the blade 40' also brings the blade contacts 42 into and out of engagement with first terminal contacts 28.

Also disclosed is a method of operating the air break electrical switch 200, the method steps comprising turning a support to move the blade 40' relative to the terminal 22, and turning the support to move the vacuum bottle electrical contacts and to move the blade contacts relative to the terminal contacts.

More particularly, when the blade support housing 47 moves the vacuum bottle contacts and moves the blade contacts relative to the terminal contacts. When moving the blade contacts into engagement with the terminal contacts, the vacuum bottle contacts come together after bringing the blade contacts into engagement with the first terminal contacts, and when moving the blade contacts out of engagement with the terminal contacts, the vacuum bottle contacts separate before moving the blade contacts out of engagement with the terminal contacts. More particularly, as described below, the drive crown 66' rotates with, but does not translate relative to, the blade first portion 290. And the slide crown 72' translates, but does not rotate, relative to the blade support 38. Thus, rotation of the drive crown 66' rotates the blade first portion, which in turn is connected to the vacuum bottle by a blade support housing 296 (see FIG. 20) extending between the vacuum bottle and the blade first portion 290, rotates the vacuum bottle 256, which in turn rotates the blade contacts 42. Translation of the slide crown 72' translates the collar 209 relative to the first blade portion 290, which pivots the bistable links 210 which in turn translate a drive piston 212 relative to the first blade portion 290, which in turn moves the vacuum bottle movable contact 234, as further described below.

The blade 40' includes a first blade portion 290 connected to the vacuum bottle 256, with the vacuum bottle movable contact 234 slidably connected to the blade first portion 290, coaxial with the blade first portion, and translatable relative to the first portion.

The air break electrical switch 200 further includes means for translating the vacuum bottle movable contact 234 relative to the blade first portion 290, this means comprising the slide crown 72' being translatable along the blade first portion 290, and means between the slide crown 72' and the movable contact 234 for moving the movable contact 234.

Further, in order to insure the vacuum bottle contacts 232 and 234 close before engaging or open before disengaging the blade contacts 42 and the terminal contacts 28, the air break electrical switch 200 further includes means for introducing hysteresis into a drive crown 66' to first blade portion 290 connection. More particularly, the first blade portion 290 is received within and coaxial with the tubular drive crown 66', and is free to rotate relative to the drive crown 66', except for a pin 227 connected to the first blade portion 290 received within a circumferentially extending slot 228 in the drive crown 66' (see FIG. 14). Initial rotation of the drive crown 66' causes the slot 228 to move relative to the pin 227. Thus, initial movement of the drive crown 66' does not rotate the first blade portion 290, thus permitting movement of the vacuum bottle contacts 232 and 234 before the pivoting of the first blade portion 290 and the engaging or disengaging of the blade contacts 42 and the first terminal contacts 28.

The switch 200 also includes contact connecting means slidably connecting the movable contact 234 to the blade first portion 290. More particularly, the blade first portion 290 is in the form of a blade tube, and the contact connecting means comprises the drive piston 212 coaxially with the blade tube 290 and mounted within the blade tube and connected to the movable contact 234, via a weld break hammer 223 and weld break housing 224, as described below.

The means between the slide crown 72' and the movable contact 234 for moving the movable contact 234 comprises a bistable assembly including bistable links 210 and a translatable latching and tripping collar 209. In other less preferred embodiments, the means between the slide crown and the movable contact for moving the movable contact could be a direct connection between them.

More particularly, the collar 209 is connected to the slide crown 72' by a fastener 280 (see FIG. 11) at lugs 294 (see FIG. 14, where the fastener is not shown) and the collar 209 is mounted for translational movement relative to the blade first portion 290. The bistable links 210 are connected to the blade first portion 290 and to the movable contact 234, so that movement of the bistable links 210 moves the drive piston 212 and the movable contact 234 relative to the blade first portion 290, so that movement of the collar 209 results in movement of the bistable links 210 between an open stable position (see FIG. 17) and a closed stable position (see FIG. 18). The relative positions are stable for pivot point between the two bistable links lies either on one side or the other of a line between the pivot points on the ends of the links.

More particularly, the bistable links 210 include a first link 242 and a second link 246 pivotally connected at one end to an end of the first link 242. The other end of the first link is pivotally connected to the drive piston 212, and the other end of the second link is pivotally connected to the blade tube. Further, the second link 246 includes a trip end 252 extending past the point of connection of the second link 246 to the blade tube, and a hump or cam 250 on the end of the second link attached to the first link. The cam 250 extends radially outwardly from the blade 40'. The latching and tripping collar 209 has an internal conical surface 260 adjacent to the second link 246.

More particularly, when the vacuum bottle contacts 232 and 234 are closed, and the bistable links 210 are not pivoted relative to each other, and when the latching and tripping collar 209 moves away from the vacuum bottle 256, the internal surface of the collar 209 engages the trip end 252, causing the pivotal connection between the first link and the second link to move radially outwardly relative to the blade first portion 290, powered by a bottle opening spring 214 extending between the drive piston 212 and the vacuum bottle 256, going over center, and thus quickly moving the contacts 232 and 234 into the open position.

When the vacuum bottle contacts are open, and the bistable links are pivoted relative to each other, and when the latching and tripping collar 209 moves toward the vacuum bottle 256, the conical surface 260 engages the cam 250, causing the pivotal connection between the first link and the second link to move radially inwardly relative to the blade, becoming over center, and thus moving the contacts into the closed position.

OPERATION

The air break switch begins in the closed position with the contacts of the vacuum bottle 256 touching and blade contacts or profiles 42 locked into a jaw or first terminal 22 and electrically connected to contact fingers or first terminal contacts 28. As a toggle lever or blade drive 60 is turned via an outside lever arm, it rotates a first toggle or over center member or drive crown 66'. The blade 40' is rotated variably with a drive crown 66' via a pin 227 and slot 228. As the drive crown 66' rotates, which is constrained linearly, its teeth push against a second toggle or over center member or slide crown 72'. This forces the slide crown 72' to move laterally. The slide crown 72' is constrained by the lugs 294 contacting the housing 47, as shown in FIG. 14, so that the slide crown 72' cannot rotate relative to the housing 47, but it can translate relative to the blade 40'.

Figure 14:
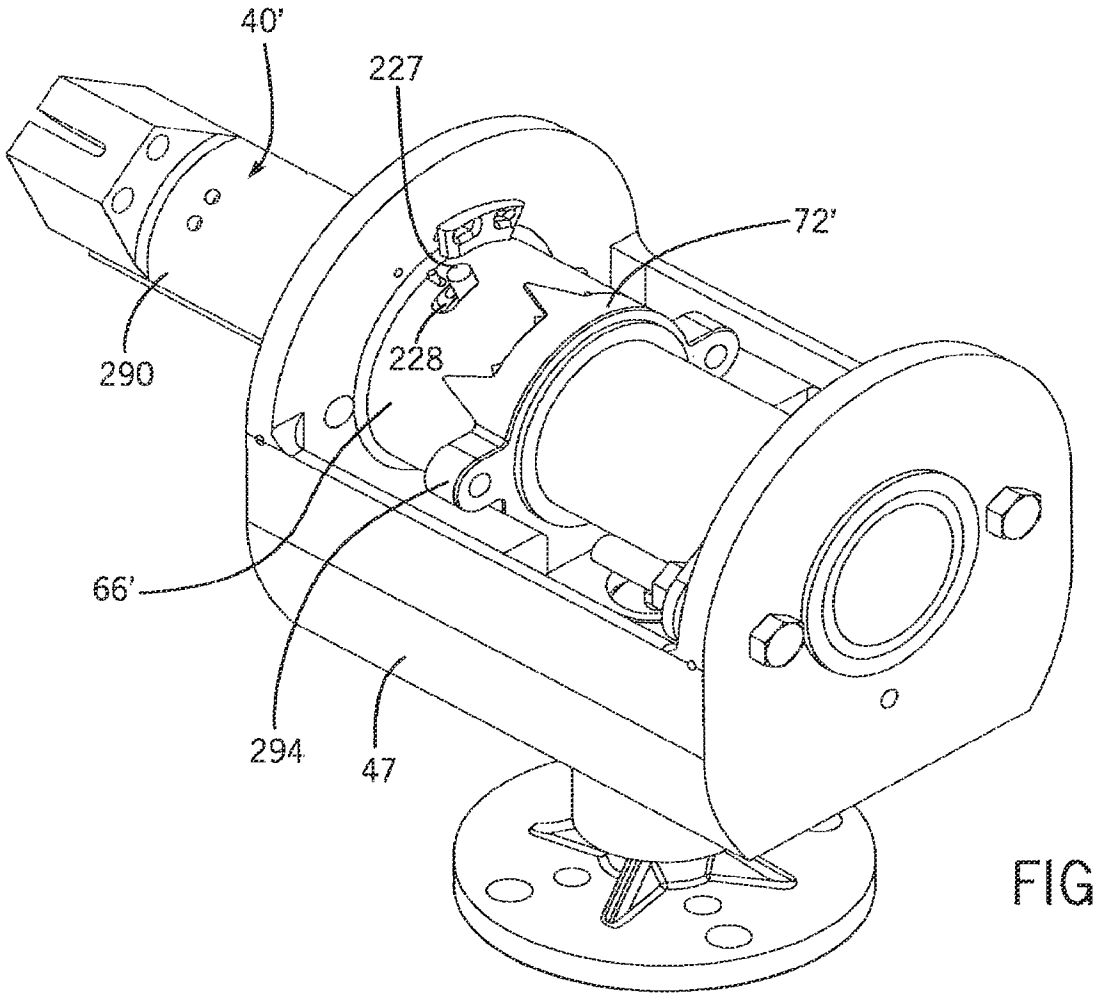
FIG. 14 is a perspective view of a toggle mechanism of the air break switch of FIG. 11 with a blade support housing removed for clarity, with a slide crown and a drive crown in a fully engaged position, with the vacuum bottle contacts closed just before disengaging the blade contacts and terminal contacts.

FIG. 14 illustrates the blade tube pin and drive crown assembly in a closed position. More particularly, the pin 227 fixed to the blade 40' first rotates in the slot 228 in the drive crown 66', allowing the drive crown 66' to rotate 15 degrees before it begins to rotate the blade tube. This allows the jaw profiles 42 to maintain electrical contact with the contact fingers 28. This first 15 degree rotation of the drive crown 66' forces the linearly constrained slide crown 72' to move laterally away from the vacuum bottle 256.

Figure 11:
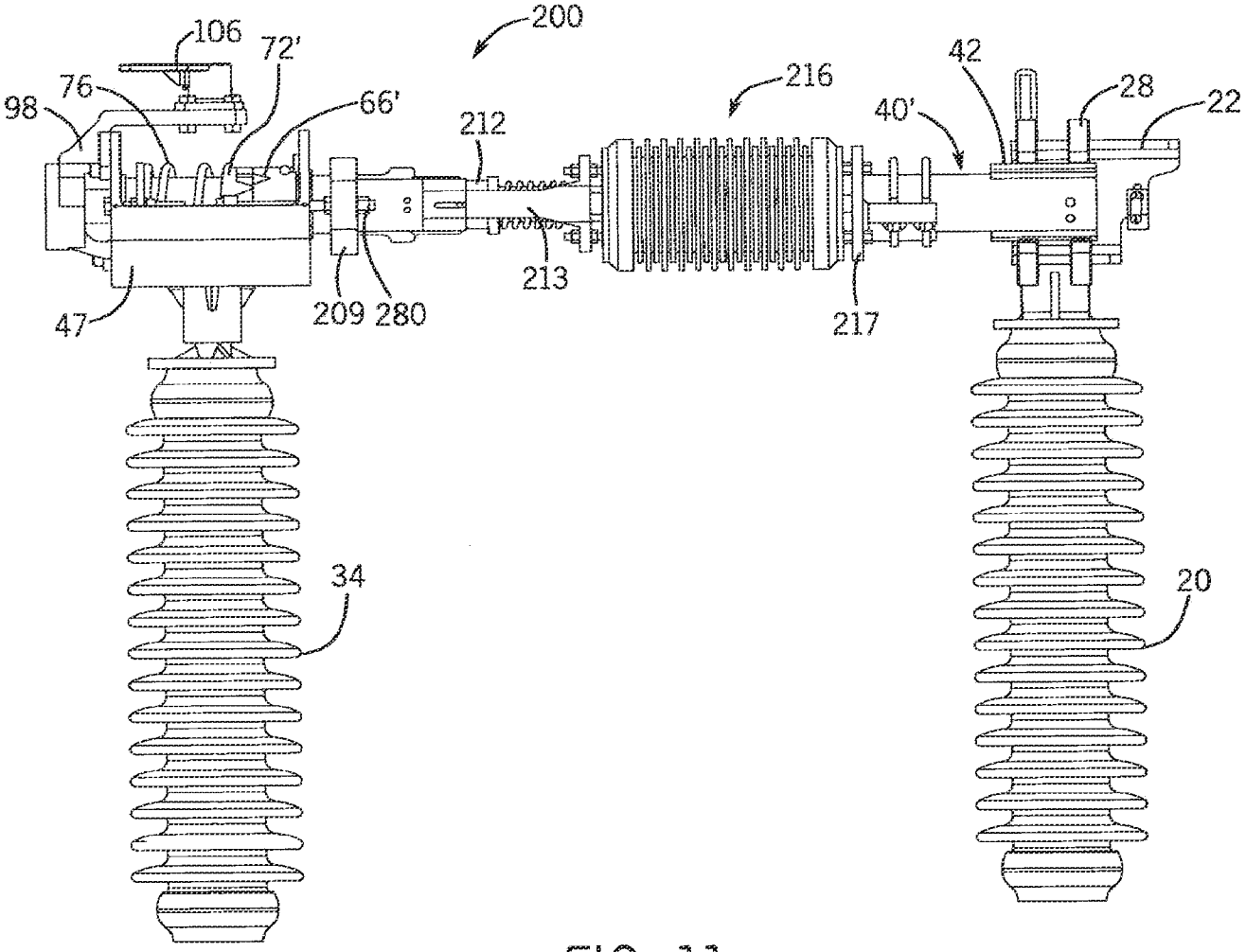
FIG. 11 is a side view of an air break electrical switch according to this disclosure, with a housing removed so the interior of the housing, which connects a blade first portion and a vacuum bottle, is visible.
Figure 12:
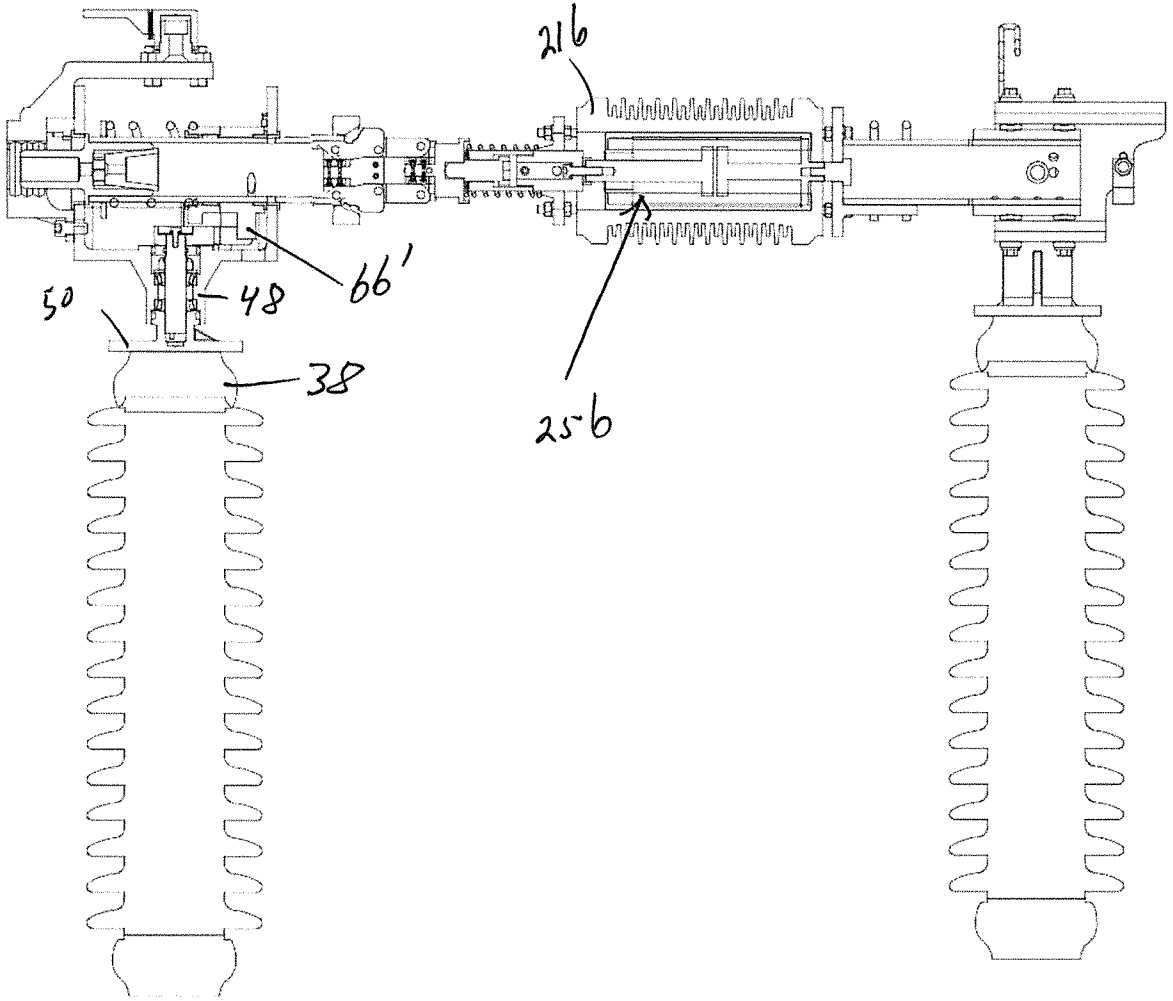
FIG. 12 is a side cross sectional view of the air break switch of FIG. 11 illustrating a vacuum bottle with a stationary and a moveable contact, with the contacts together.
Figure 13:
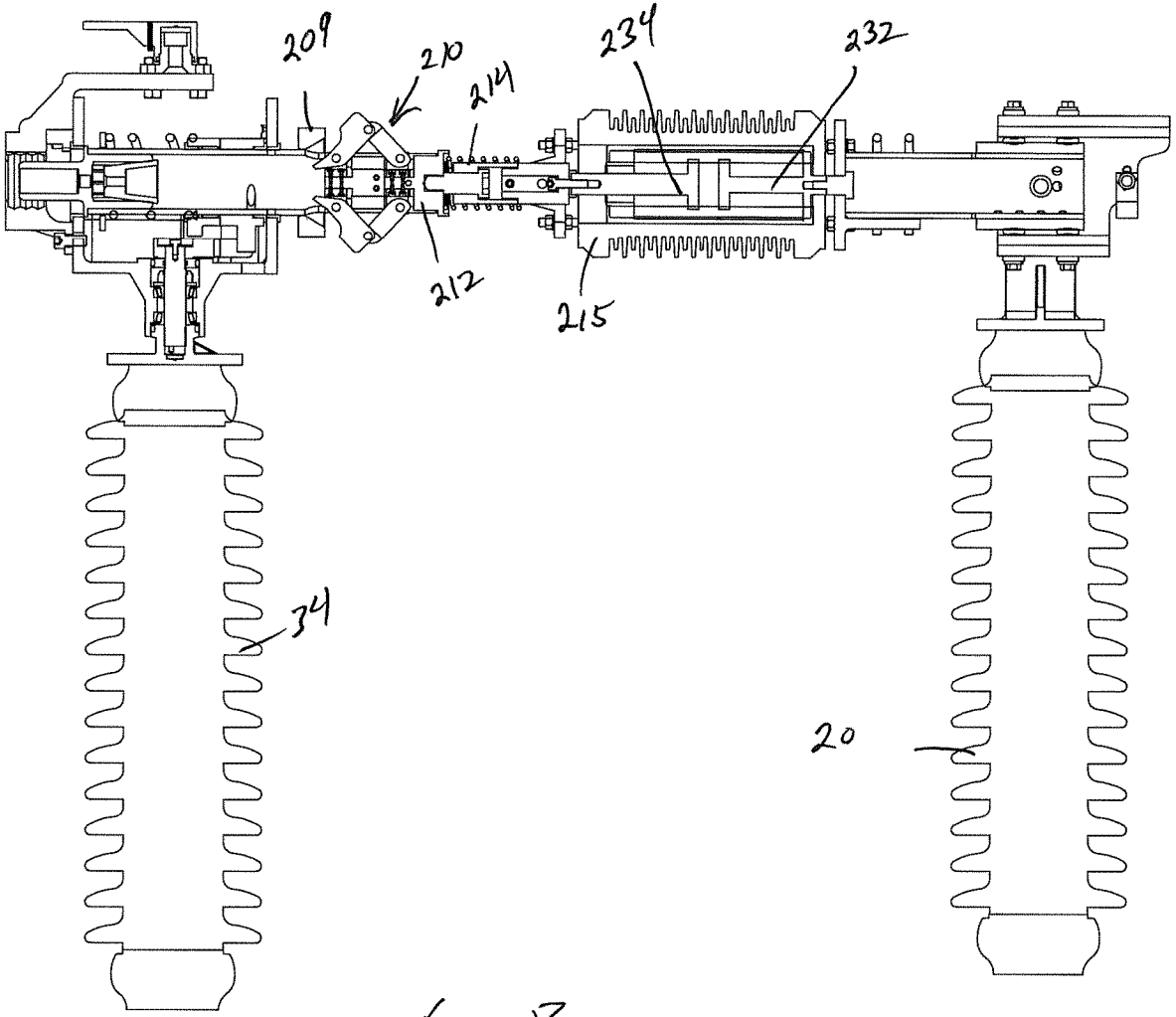
FIG. 13 is a side cross sectional view of the air break switch of FIG. 11 illustrating the vacuum bottle with the contacts separated.

The slide crown 72' is connected to the latching and tripping collar 209 by a fixed length fastener 280 (see FIG. 11). As the slide crown 72' moves away from the vacuum bottle 256, the latching and tripping collar 209 also moves laterally with the slide crown 72' away from the vacuum bottle 256.

Once the latching and tripping collar 209 displaces, it trips the bistable links 210 to move over center, towards the open position. When the bistable links 210 move to the open position, the moving contact on the vacuum bottle 256 moves to the open position. The free end of the first link 242 is pivotally connected to the drive piston 212, and the free end of the second link is pivotally connected to the latching and tripping collar 209 slidable along a vacuum bottle to mechanism adapter 213. Further, the second link 246 includes a trip end 252 extending past the point of connection of the second link 246 to the vacuum bottle to mechanism adapter 213, and a hump or cam 250 on the end of the second link attached to the first link. The cam 250 extends radially outwardly from the blade 40'. The latching and tripping collar 209 has an internal conical surface 260 adjacent the second link trip end 252.

When the bistable links are closed, and when the latching and tripping collar 209 moves away from the vacuum bottle 256, the internal surface of the collar 209 engages the trip end 252, causing the pivotal connection between the first link and the second link to move radially outwardly relative to the blade, going over center, and thus quickly collapsing the bistable links and moving the contacts into the open position.

When the bistable links are open, and when the latching and tripping collar 209 moves toward the vacuum bottle 256, the conical surface 260 engages the cam 250, causing the pivotal connection between the first link and the second link to move radially inwardly relative to the blade, becoming over center, and thus moving the contacts into the closed position.

Figure 16:
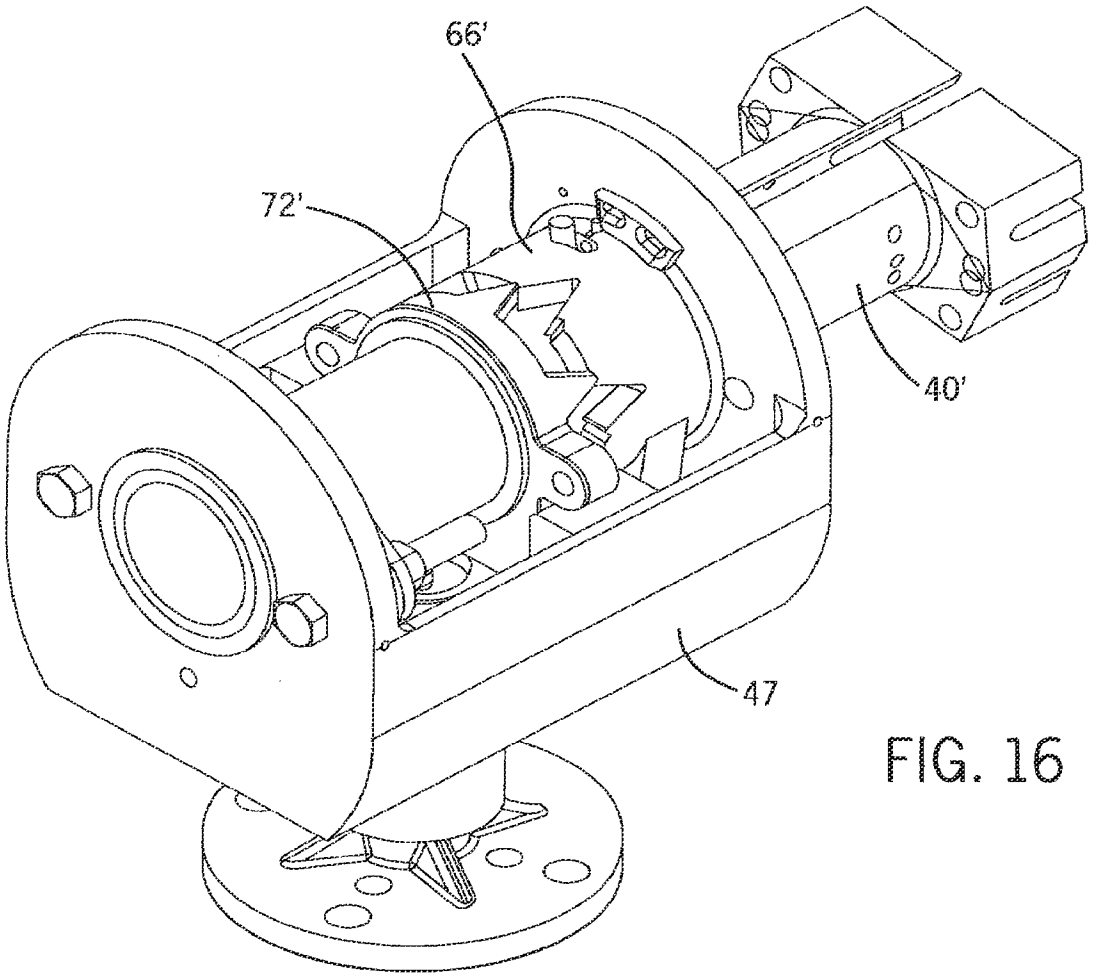
FIG. 16 is a perspective view of the toggle mechanism of FIG. 14 with the slide crown and the drive crown in a second fully disengaged position; with the blade tube pin, slot and the drive crown in the blade contacts closed position, vacuum bottle open position.

FIG. 16 illustrates the blade tube pin and drive crown assembly shown in the blade contacts closed position, and the vacuum bottle open position. More particularly, at this point the vacuum bottle 256 is in the open position, and the blade profiles 42 are still engaged with the jaw finger contacts 28.

The drive crown is now rotated 30 degrees further allowing the blade profiles 42 to be disengaged from the jaw finger contacts 28. Since the vacuum bottle 256 is in the open position, disengagement of the jaw contacts and profiles can be accomplished without electrical arcing. Thereby the switch can be opened in this sequence even with an electrical load without arcing.

Figure 15:
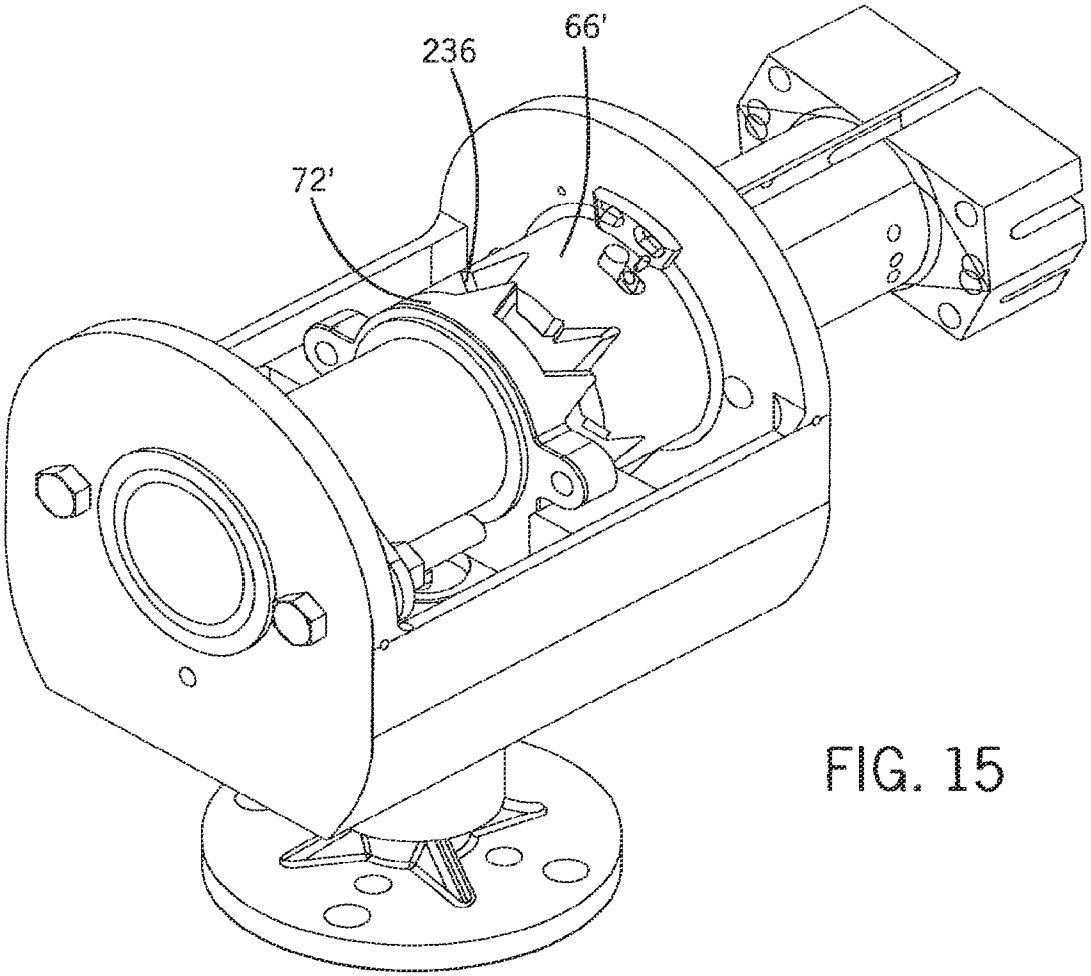
FIG. 15 is a perspective view of the toggle mechanism of FIG. 14 with the slide crown and the drive crown in a first fully disengaged position; with a blade tube pin, slot and drive crown in the blade contacts open and the vacuum bottle open position.

FIG. 15 illustrates the blade tube pin and drive crown assembly in the blade contacts open and the vacuum bottle open position. More particularly, the switch can then be closed without arcing, even under electrical load, by the same sequence in reverse.

Figure 17:
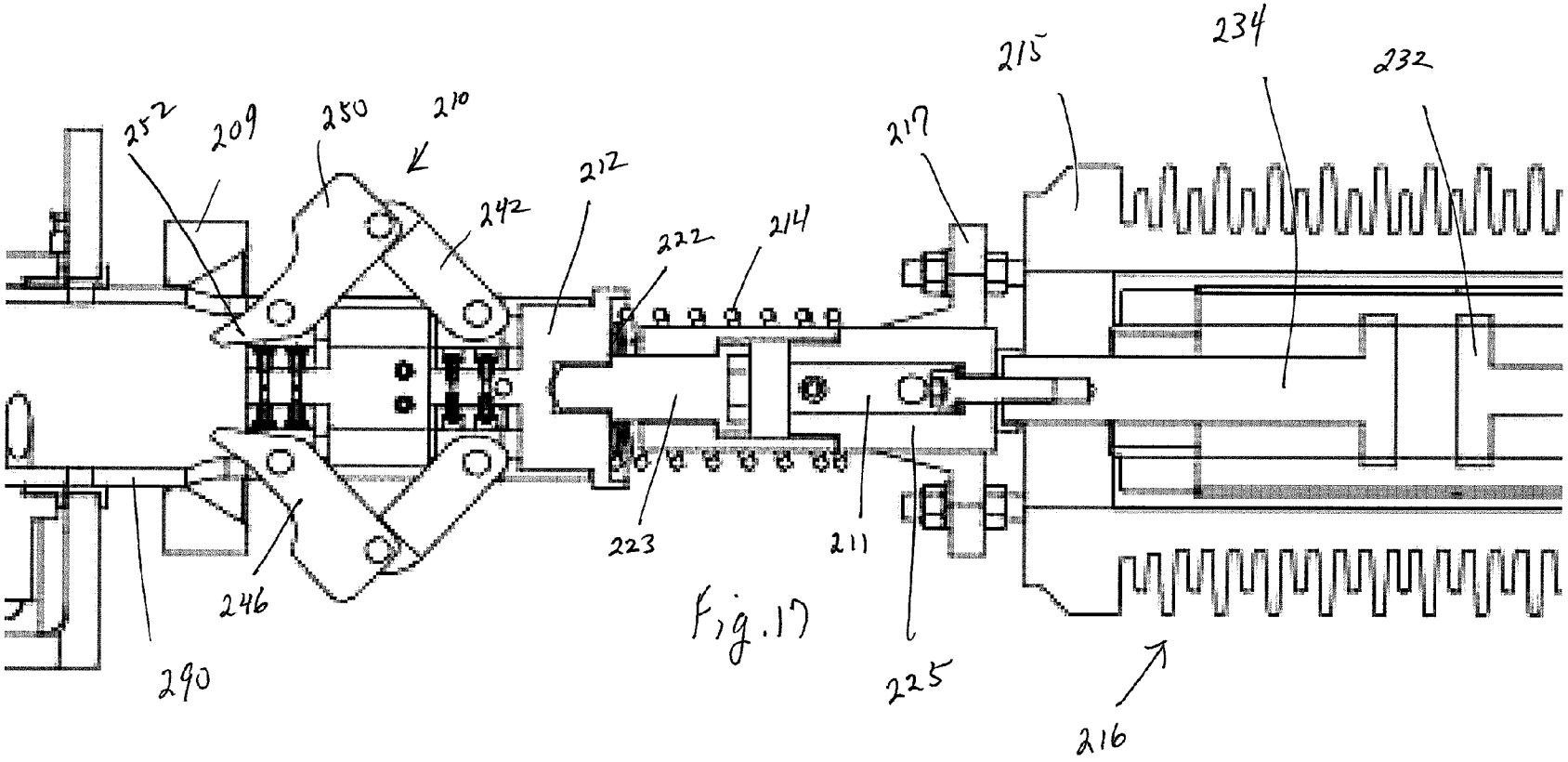
FIG. 17 is an enlarged view of the bistable assembly and vacuum bottle shown in FIG. 13.

FIG. 17 illustrates a sectional view of bistable and weld break design shown in the open position. More particularly, the bistable links 210 are fixed to the drive piston 212. As they move into the open position, the drive piston 212 moves laterally away from the vacuum bottle 256. The weld break hammer 223 is threaded into the drive piston 212 and also moves laterally away from the vacuum bottle 256 as the bistable links 210 open.

The weld break hammer 223 initially slides laterally freely, before hitting the shoulder of the weld break housing 224. This impact provides the impulse needed to break apart any welding between the vacuum bottle contacts that may have occurred during the vacuum bottle 256 closing.

In order to compensate for wear to the load interrupter contacts and subsequent decreased contact pressure, Belleville washers 222 are placed in between weld break housing 224 and the drive piston 212.

The weld break housing 224 is fixed to the current braid (not shown) to moving contact adapter 225 which is also fixed to the moving contact 234 of the vacuum bottle 256. When the weld break hammer 223 impacts the shoulder of the weld break housing 224 the lateral motion is transferred to the current braid to moving contact adapter 225 and subsequently to the moving contact 234, opening the contacts in the vacuum bottle 256.

As the blade drive 60 continues to turn and push on the drive crown 66' the blade 40' rotates, moving the profiles 42 so that they are no longer in contact with the jaw contact fingers 28. The blade 40' then swings out of the first terminal or jaw 22 90 degrees to fully open the switch and create the open gap for the switch.

In total, the blade 40' moves 45 degrees, until the drive crown 66' and the slide crown 72 are interlocked as shown in FIG. 15.

The drive or compression spring 214 provides pressure on the slide crown 72, providing the stored energy to drive the bistable links back to the closed position when the switch is closed.

Figure 18:
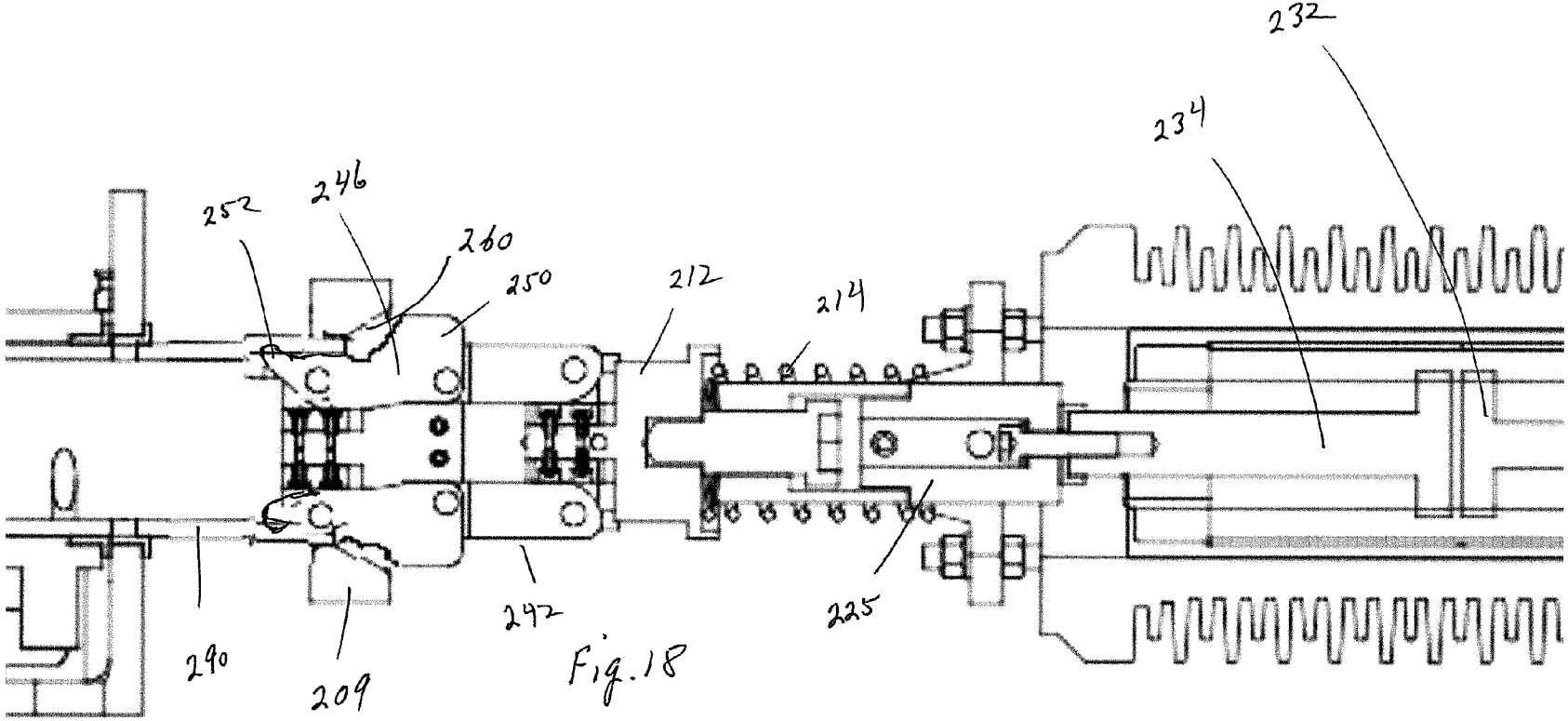
FIG. 18 is an enlarged view of the bistable assembly and vacuum bottle shown in FIG. 12.
Figure 19:
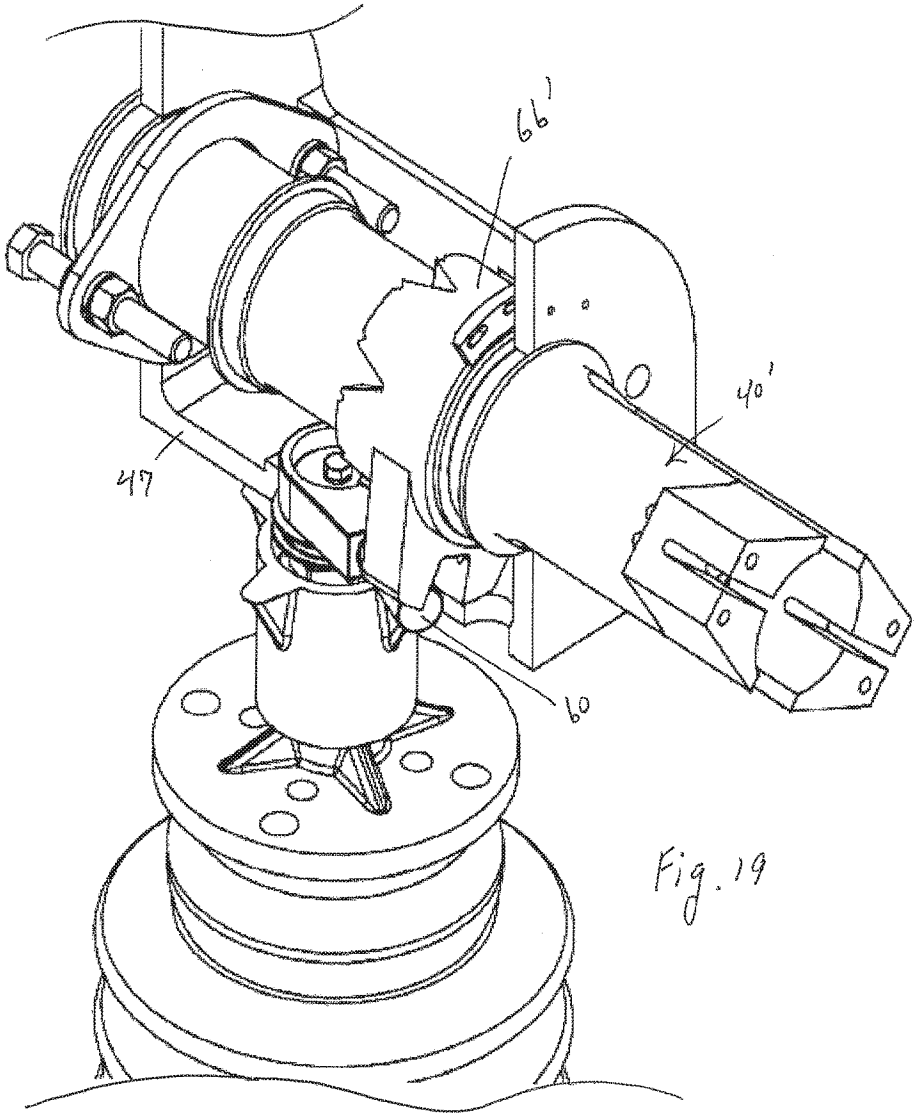
FIG. 19 is a perspective view of a toggle mechanism of the switch with the blade support housing and the slide crown removed for clarity.
Figure 20:
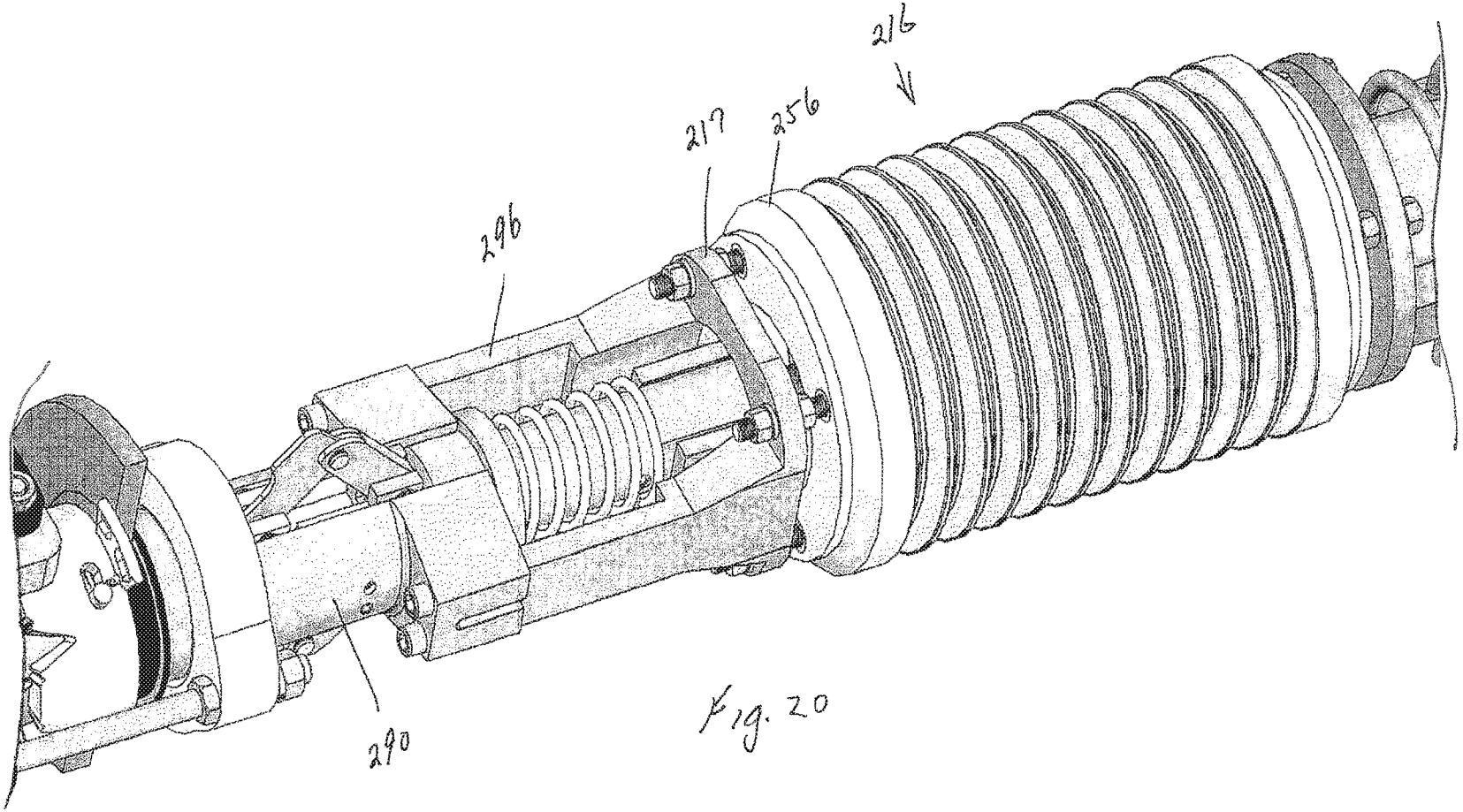
FIG. 20 is a perspective view of the bistable assembly and vacuum bottle shown in FIG. 17, with the blade support housing connecting a first blade portion to the vacuum bottle.

FIG. 18 illustrates a section view of bistable and weld break design shown in the closed position. More particularly, to close the vacuum bottle the blade drive 60 is rotated in the opposite direction. The movement of the blade drive 60 rotates the blade 40' back into the jaw. The blade 40' then rotates the profiles 42 back into contact with the jaw contact fingers 28. The rotation of the blade drive 60 also rotates the drive crown 66', once again forcing the lateral movement of the slide crown 72. The pin fixed in the blade 40' is allowed to rotate 15 degrees separate from the rotating drive crown 66', as controlled by the pin and slot mechanism. Small notches on either side of the crown points aid in providing proper registration between the slide crown and the drive crown prior to the interdigitating of the respective crown points.

Then the blade tube 42 profiles are rotated 30 degrees to engage the finger contacts. The pin mechanism releases allowing the slide crown 72' to move forward toward the vacuum bottle 256.

Because of the unique tooth profile on the drive crown 66', the drive crown 66' must only rotate a small amount before the slide crown 72 is able to move suddenly forward, towards the vacuum bottle 256.

The drive spring 76 provides the force to accelerate the slide crown 72 towards the vacuum bottle 256 at the correct rate.

The lateral movement of the slide crown 72 causes the latching and tripping collar 209 to accelerate towards the vacuum bottle 256. The latching and tripping collar 209 collides with the bistable links 210, forcing them into the closed position. The closing of the bistable links 210 causes the drive piston 212 to move laterally towards the vacuum bottle. The movement of the drive piston 212 moves the weld break hammer 223, the moving contact adapter 225 to move laterally, forcing the moving contact 234 into the closed position, and closing the vacuum bottle 256.

Preferred embodiments of the disclosure have been described in considerable detail. Many modifications and variations to the preferred embodiments described will be apparent to a person of ordinary skill in the art. Therefore, the disclosure should not be limited to the embodiments described, but should be defined by the claims that follow.

We claim:

1. A high voltage/high current air break switch, the switch comprising:

a support frame;

a first electrical terminal electrically insulatively supported by the frame, the first electrical terminal including at least one blade contact;

a blade support housing electrically insulatively supported by the frame and disposed apart from the first electrical terminal, the blade support housing being pivotally supported so as to be pivotable about a first axis relative to the frame;

a blade supported by the blade support housing so as to be pivotable about a second axis relative to the blade support housing, the blade including a load interrupter between the blade support and a distal end of the blade; and means between a second toggle mechanism and one of the load interrupter contacts for moving one contact and comprising a bistable assembly including bistable links and a translatable latching and a tripping collar, whereby pivotal movement of the blade from an open blade position, in which the blade distal end is spaced apart from the electrical terminal, to a closed blade position, in which the blade distal end enters the electrical terminal and wherein the blade has a longitudinal axis, and the load interrupter has contacts extending along the blade longitudinal axis between the blade support and the distal end of the blade.

2. The high voltage/high current air break switch according to claim 1 wherein, the collar is connected to the second toggle mechanism, and the collar is mounted for translational movement relative to the blade.

3. The high voltage/high current air break switch according to claim 2 wherein the bistable links are connected to the blade first portion and to the one contact, so that movement of the bistable links moves a drive piston and the one contact relative to the blade first portion, so that movement of the collar results in movement of the bistable links between an open stable position and a closed stable position.

4. The high voltage/high current air break switch according to claim 3 wherein the bistable links include a first link and a second link pivotally connected at one end to an end of the first link, and the other end of the first link is pivotally connected to the drive piston, and the other end of the second link is pivotally connected to the first blade portion.

5. The high voltage/high current air break switch according to claim 4 wherein the second link includes a trip end extending past the point of connection of the second link to the blade first portion, and a hump on the end of the second link attached to the first link, the hump extending radially outwardly from the blade first portion.

* * * * *